US007175181B1

(12) United States Patent
Bateman et al.

(10) Patent No.: US 7,175,181 B1
(45) Date of Patent: Feb. 13, 2007

(54) PORTABLE SHOOTING TARGET

(75) Inventors: Kyle Bateman, Provo, UT (US); Kyle Burdette, Eagle Mountain, UT (US); Tom Marshall, Lake Shore, UT (US)

(73) Assignee: Action Target, Inc., Prova, UT (US)

( * ) Notice: Subject to any disclaimer, the term of this patent is extended or adjusted under 35 U.S.C. 154(b) by 0 days.

(21) Appl. No.: 11/153,178

(22) Filed: Jun. 15, 2005

Related U.S. Application Data

(60) Provisional application No. 60/581,051, filed on Jun. 17, 2004.

(51) Int. Cl.
*F41J 5/14* (2006.01)

(52) U.S. Cl. ..... 273/392

(58) Field of Classification Search ..... 273/390–392, 273/406, 407

See application file for complete search history.

(56) References Cited

U.S. PATENT DOCUMENTS

| | | | | | |
|---|---|---|---|---|---|
| 694,581 | A | | 3/1902 | Rerchlin | |
| 2,085,933 | A | * | 7/1937 | Vaughan | 273/388 |
| 2,613,934 | A | | 10/1952 | Tabler | |
| 2,670,959 | A | | 3/1954 | Broyles | |
| 4,272,078 | A | | 6/1981 | Vinette | |
| 4,458,901 | A | | 7/1984 | Wojcinski | |
| 4,509,301 | A | | 4/1985 | Head | |
| 4,614,345 | A | * | 9/1986 | Doughty | 273/381 |
| 4,726,593 | A | * | 2/1988 | Wade | 273/392 |
| 4,913,389 | A | * | 4/1990 | McCracken | 248/156 |
| D329,680 | S | | 9/1992 | Burn | |
| 5,400,692 | A | | 3/1995 | Bateman | |
| 5,598,996 | A | * | 2/1997 | Rath | 248/163.1 |
| 5,811,718 | A | | 9/1998 | Bateman | |
| 5,947,477 | A | * | 9/1999 | Turnipseed | 273/407 |
| 6,478,301 | B1 | * | 11/2002 | Witmeyer | 273/391 |
| 6,776,418 | B1 | * | 8/2004 | Sovine et al. | 273/407 |
| 6,808,177 | B2 | * | 10/2004 | Dehart | 273/406 |
| 6,896,267 | B1 | * | 5/2005 | Le Anna | 273/391 |

OTHER PUBLICATIONS

1995 Guide to Affordable Target Technology, DuelATron Target System.
Porta Target Information Packet.
Caswell International Corp. Information Packet.
SuperTrap Bullet Containment Systems Information Packet.

* cited by examiner

*Primary Examiner*—Mark S. Graham
(74) *Attorney, Agent, or Firm*—Bateman IP Law Group

(57) ABSTRACT

A portable bullet target configured to improve the skills of a shooter includes, in one embodiment, a shooting plate which is attached to a frame by protrusions integral to the shooting plate to allow the shooting plate to visually deflect when hit by a bullet and to substantially return to its original position. In another embodiment, a foot or feet are attached to the frame to support the target. According to another embodiment, a plurality of portable targets are used in combination and may be attached together.

29 Claims, 5 Drawing Sheets

PORTABLE SHOOTING TARGET

1. RELATED APPLICATIONS

The present application claims the benefit of U.S. Provisional Patent Application 60/581,051, filed Jun. 17, 2004.

BACKGROUND OF THE INVENTION

1. Field of the Invention

The present invention relates to improved bullet targets. More specifically, the present invention relates to modular targets which improve the function of the target to improve shooter abilities and to decrease broken targets.

2. State of the Art

In order to maintain proficiency in the use of firearms, it is common for law enforcement officers and sportsmen to engage in target practice. Target practice is both enjoyable to the individual and valuable training to increase the individual's skills and efficiency with a firearm. Accordingly, target practice increases the ability of an individual to use a firearm safely and effectively.

The use of shooting ranges for target practice provides a level of training which is difficult to duplicate in other types of target practice. Shooting ranges can provide multiple targets, moving targets, and other stimulus which may increase the effectiveness of the target practice in training the individual.

While target practice in a shooting range is advantageous, it is not always available to an individual desiring target practice. Accordingly, there is a need for portable shooting targets which allow an individual to achieve adequate practice with his or her firearm.

Portable targets have been used for some time. Many of these targets are limited in use. Because of the design of the targets, some targets may only be used where there is soft dirt into which stakes or metal poles which may be attached to the target may be inserted. Such targets can not be used where the ground is too hard to allow insertion of the stakes or poles. Likewise, they can not be used on asphalt or concrete.

Additionally, such targets may become loosened with use, as the impact of projectiles hitting the target moves the target and loosens the stakes or poles from the ground into which they are inserted. A target which becomes loose during use may become unsafe and ineffective to use for target practice.

Additionally, some targets are not suitable for use with larger firearms. Many targets are constructed by welding metal plates together, by bending or twisting metal plates, by using nuts or bolts to hold pieces of the target together, or by using hinges or other attachment mechanisms. Such construction methods are prone to failure with repeated use. The heat involved with welding metal may weaken the metal surrounding the joint. Additionally, welds tend to be brittle as compared to the metal itself, and welds are more prone to failure than plain metal plate. Additionally, welding increases the time and cost necessary to produce a target. Similarly, bending or twisting metal may make the metal more brittle and more prone to failure. The additional steps and machinery necessary to bend or twist the metal increase the cost to manufacture the target.

The use of bolts and hinges to manufacture targets is also disadvantageous, as the nuts, bolts, or hinges may be loosened or destroyed with use. The vibration of projectiles repeatedly hitting the target will typically loosen the nuts, bolts, or hinges. Loose joints on a target will make the target less functional and unsafe. Additionally, projectiles directly hitting the nuts, bolts, or hinges of a target may destroy the nuts, bolts, or hinges. For some bullets, a single bullet or a few bullets may destroy a nut, bolt, or hinge when striking it directly.

Some targets are simply made too thin or too weak to be useful as a target for larger firearms. The metal used for constructing the target may be too soft because of manufacturing constraints such as cutting, bending, or shaping, cost limitations, etc. For example, a twisted piece of metal for use as a target must usually be mild steel rather than hardened steel. Other targets are too expensive for many individuals.

Thus, there is a need for simple bullet targets which provide improved functionality for training and with improved wear characteristics.

SUMMARY OF THE INVENTION

It is the object of the present invention to provide improvements in bullet targets.

In accordance with the above and other objects of the invention, an improved bullet target is provided, including a shooting plate which is configured to be impacted by a bullet, a frame for holding the shooting plate in a line of fire, and a foot or multiple feet for holding the frame in a generally vertical position.

In accordance with one aspect of the invention, the attachment mechanism is formed by an protrusion of metal from the shooting plate. The metal protrusion attaches the shooting plate to the frame in such a manner that the shooting plate will pivot and deflect each time it is hit, but will substantially return to its initial position (generally vertical) shortly after the impact. Thus, the shooting plate gives the visual appearance of being impacted as it is hit with each bullet to confirm to the shooter that he or she has hit the target. Because no hinge is directly formed on the shooting plate, the shooting plate is able to withstand a larger number of rounds without any damage to the pivoting mechanism.

In accordance with another aspect of the invention, the frame may be formed from a flat strip of steel which is bent so as to have a generally horizontal portion and two generally vertical portions. The horizontal portion is designed to be parallel with the ground, and the generally vertical portions are configured to support the shooting plate. Accordingly, the vertical portions may have holes formed in their upper ends which may receive the metal protrusions formed in the shooting plate.

In accordance with yet another aspect of the invention, the foot or feet are configured to attach to the lower portion of the frame, near or attached to the generally horizontal portion. The foot or feet are configured to extend forward and backward from the frame sufficiently to support the target and prevent the target from falling over when struck from projectiles from a firearm, bumped, confronted with wind, or other common interactions. The feet are also preferably configured to engage the frame so that the frame does not encounter a significant of splatter from bullets ricocheting off the target.

In accordance with another aspect of the present invention, the target may be configured such that multiple targets may be used in combination. The targets may be configured such that multiple targets may be attached together.

In accordance with still another aspect of the invention, the target shooting plate can be configured to present different shapes or colors or targets to the individual desiring target practice.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figures 1, 1A:
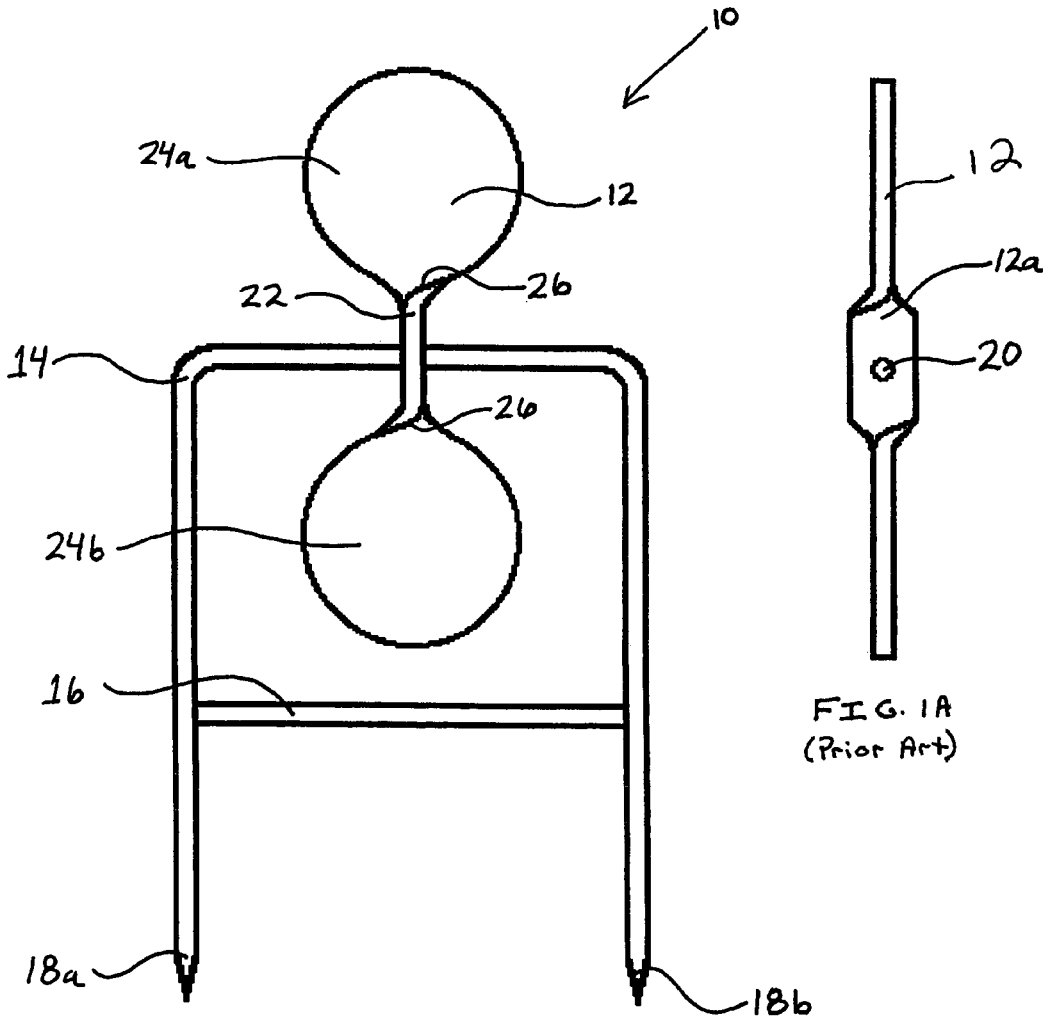
FIG. 1A (Prior Art)
FIG. 1 (prior art)
FIGS. 1 and 1A show front and side views of a target known in the prior art.

Turning now to FIGS. 1 and 1A, there is shown front and side views of a target known to the prior art, generally indicated at 10. The target includes a target plate 12 and a support piece 14, which is used to hold the target plate 12 in a line of fire. The support piece 14 further comprises a cross member 16. The cross member 16 is typically welded to the support piece 14. The support piece 14 is typically configured to have two pointed ends 18*a* and 18*b*. The pointed ends 18*a* and 18*b* are configured to be inserted into the ground. The cross member 16 may be configured to provide a place whereon the user may step to aid in pressing the ends 18*a* and 18*b* of the support piece 14 into the ground.

The weld joint between the support piece 14 and the cross member 16 creates a weak portion of the target support. During repeat fire situations, the weld can break due to the vibration of repeated rounds hitting the target plate or from direct hits to the welds by errant shots. This can eventually cause the cross member 16 to fall off of the support piece 14, or otherwise interfere with the structural integrity of the target and the ability of the user to step on the cross member 16 to drive the pointed ends 18*a* and 18*b* into the ground.

The support piece 14 is typically formed from round steel rod which is bent into the shape shown. The cross member 16 is also typically formed from round steel rod. The support piece 14 acts as a pivot for the target plate 12. The target plate 12 is usually formed with a hole 20, as shown in view of side 12*a*, through which the support piece 14 passes. The hole 20 is sized such that the target plate 12 pivots freely about the support piece 14.

The target plate 12 is typically formed from plate steel, and is typically twisted 26 at the intersection between the central portion 22 and the rounded end portions 24*a* and 24*b*. The twist 26 reduces the strength in the target as it creates a weaker location in the steel. Additionally the target plate 12 must be made of mild steel plate which allows twisting. Having a target portion which is twisted and formed of mild steel makes the target portion less durable and more prone to failure.

Targets which are formed from welded steel, or which have designs which incorporate twists, bends, or hinges, especially on the target plate or in close proximity, are more prone to failure because of how these construction methods weaken the steel or require softer steel to be used.

Additionally, the target 10 as known in the prior art must be used in an area with dirt which is sufficiently soft to allow the user to press the ends 18*a* and 18*b* of the support piece 14 into the dirt. This limits the number of areas where the target may be used. Additionally, dirt which is soft enough to allow use of the target 10 may not be hard enough to maintain the target firmly planted in the ground during a target shooting session. The holes formed in the dirt may become enlarged due to the vibrations and forces exerted on the target from the bullets striking the target. If the holes become enlarged, the target will be loosely held in the dirt, and could move with the impacts of successive bullets striking the target. This reduces the safety and effectiveness of the target.

Figure 2:
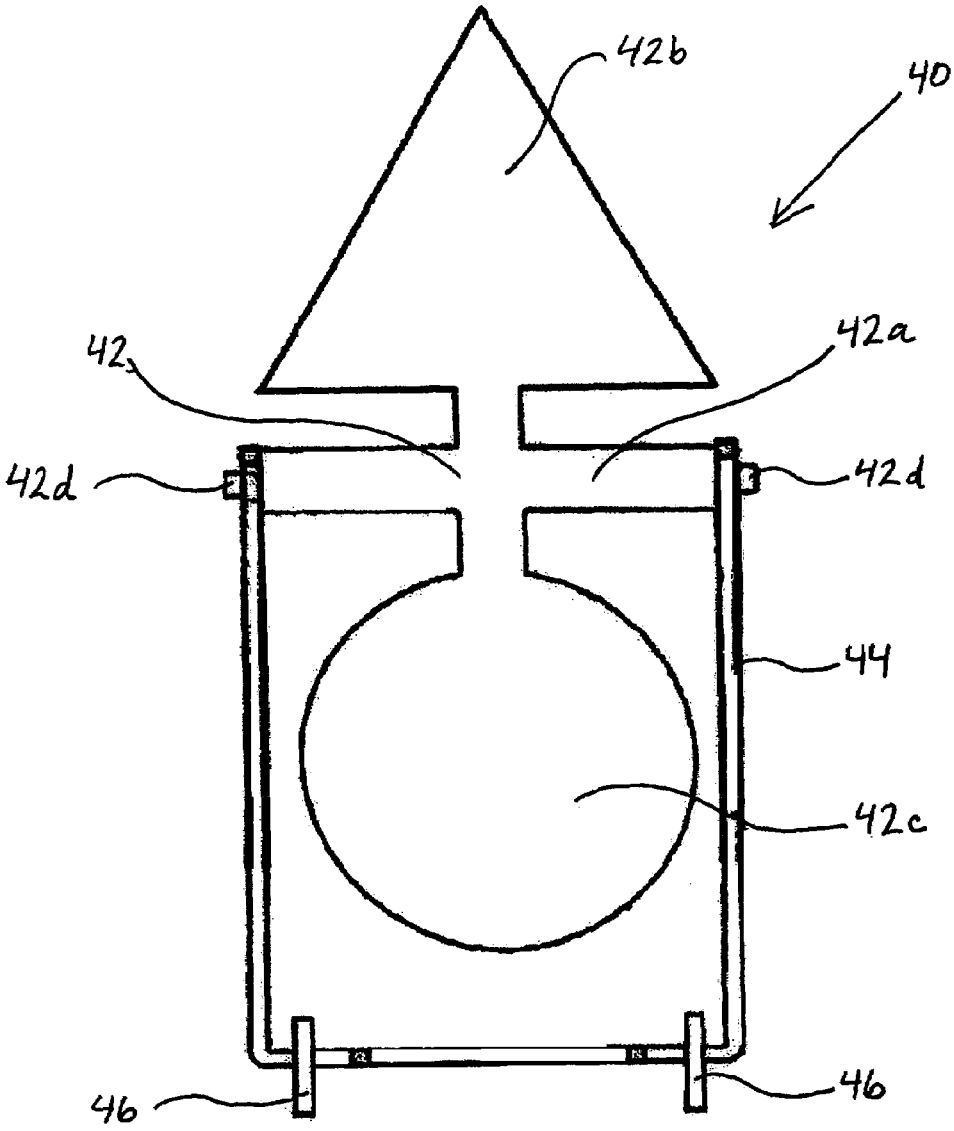
FIG. 2 shows a front perspective view of an improved target made in accordance with the principles of the present invention.

Turning now to FIG. 2, a front perspective view of a target (indicated generally at 40) made in accordance with the present invention is shown. The target 40 comprises a shooting plate 42, a frame 44, and feet 46.

The shooting plate 42 is formed from a single piece of flat steel, preferably hardened steel plate. The shooting plate 42 is typically configured to have a cross piece 42*a*, two target plates 42*b* and 42*c*, and two mounting protrusions 42*d*. Because the entire shooting plate 42 is constructed out of a single flat plate of steel, no bending, twisting, welding, etc. is required. The absence of bends or twists allows the shooting plate 42 to be constructed out of a harder steel as compared to a steel which readily allows for bending or twisting during manufacture. The harder steel and absence of bends, twists, or welds makes the shooting plate 42 stronger and less prone to failure. As discussed previously, welds, bends, or twists are prone to break from the stresses and vibrations caused by the repeated impact of bullets.

The protrusions 42*d* are designed to fit rotatably in corresponding holes (50 in FIG. 3) in the frame 44. This allows the shooting plate 42 to rotate freely when struck by a bullet. (It will be appreciated that the entire cross piece could be sized similar to the protrusions if desired.

The shooting plate 42 is typically designed to have two target plates 42*b* and 42*c*. These target plates may be a variety of shapes, such as circular, oval, rectangular, square, triangular, or polygonal, and may also be shaped to resemble animals, birds, rodents, rabbits, snakes, deer, or anything else that an individual might commonly shoot at. The two target plates 42*b* and 42*c* may also be made of different sizes. One will appreciate that the larger, and consequently heavier, of the two target plates 42*b* and 42*c* will naturally hang below the cross piece 42*a*.

The target plates 42*b* and 42*c* may also be painted or otherwise finished to be different in color. This may be done so as to make the target more accurately resemble the item depicted in the target plate. Colors may also be selected for training purposes, such that the individual shooting at the target is required to shoot targets based on color.

The target 40 may also be designed such that different shooting plates 42 may be used, depending on the training desired. A user could select a shooting plate based on the shape or color of the target plates 42*b* and 42*c*, and place the desired shooting plate 42 into the frame 44. The upper ends of the frame could be stretched apart just far enough to allow the protrusions 42*d* of the shooting plate 42 to be removed from the holes (50 in FIG. 3), and for a different shooting plate to be similarly inserted into the frame 44.

The target 40 is also typically configured to have a foot or multiple feet 46. The embodiment shown is configured to have two feet 46, which attach to the lower portion of the frame 44. The foot or feet 46 are typically designed to extend forwards and backwards from the target 40 to adequately support the target 40. The feet 46 are designed such that the target 40 will not fall over during any occurrence which will commonly occur while an individual is engaged in target practice.

Figure 3:
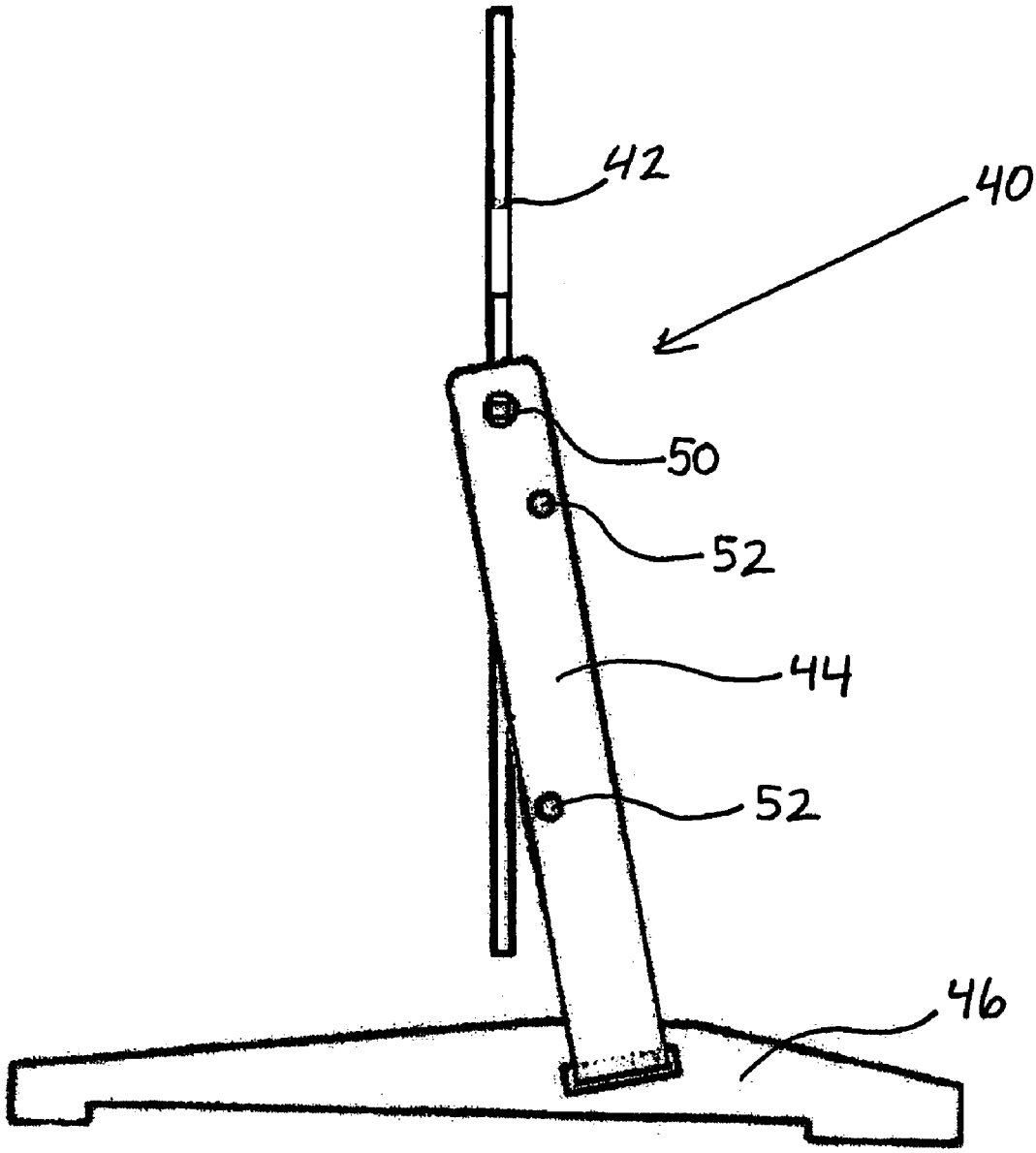
FIG. 3 shows a side perspective view of an improved target made in accordance with the principles of the present invention.

Turning now to FIG. 3, a side perspective view of the target of FIG. 2, indicated generally at 40, and made in accordance with the present invention is shown. The target 40 comprises a shooting plate 42, a frame 44, and feet 46. FIG. 3 more clearly shows the holes 50 formed in both sides of the frame 44 and configured to receive the protrusions (42*d* of FIG. 2) of the shooting plate 42. Also visible in FIG. 3 are connecting holes 52 which may be formed in the sides of frame 44. The connecting holes 52 may be used to connect multiple targets 40 together, as will be discussed.

The feet 46 are shown to extend forwards and backwards from the frame 44. The feet 46 may extend further backwards from the frame 44 to prevent the target 40 from falling backwards from the impact of bullets striking the target.

One important aspect of the feet 46 is that they engage the frame 44 so that the frame is held at an angle less than vertical. In such a manner, bullet fragments ricocheting off the shooting plate 42 are more likely to impact the ground than the frame 44. This reduces wear on the frame and provides improved longevity. For example, if a shooter shoots toward the shooting plate from the left, bullets fragments will ricochet off the plate downwardly and outwardly prior to impacting the frame 44.

Figure 4:
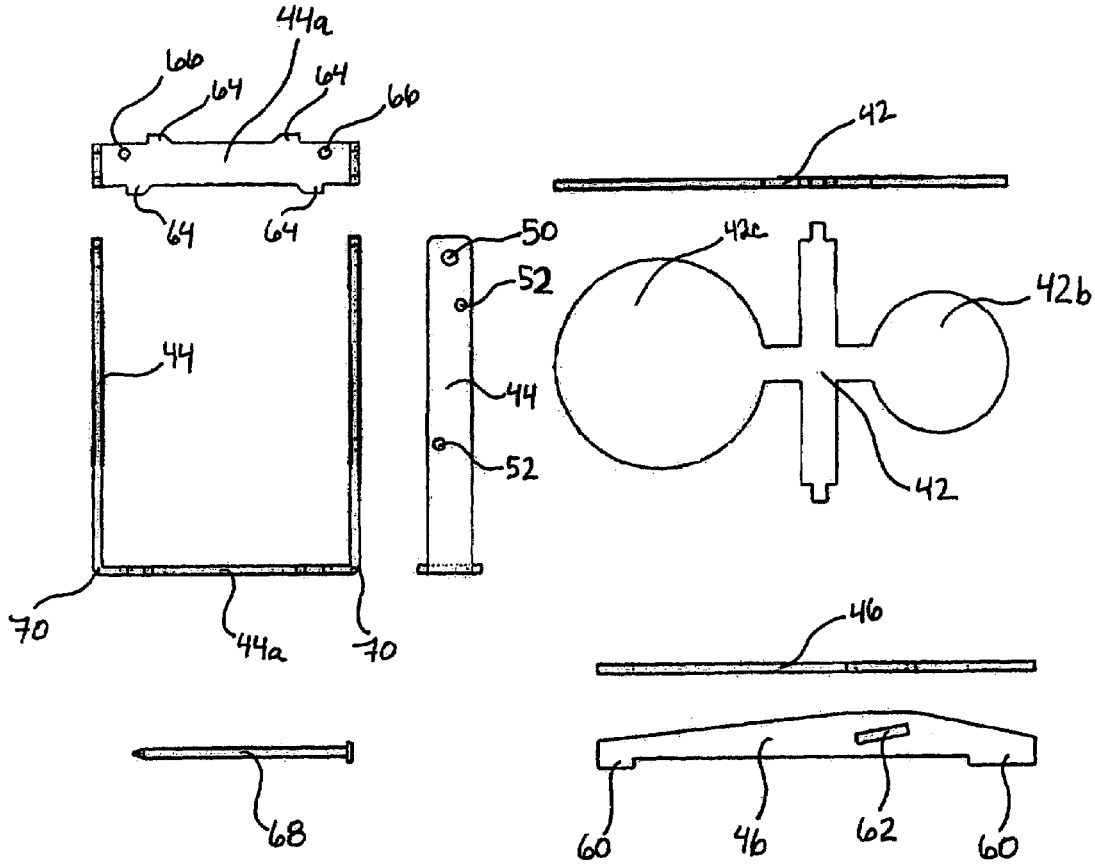
FIG. 4 shows a disassembled view of the individual pieces of an improved target made in accordance with the principles of the present invention.

Turning now to FIG. 4, multiple views of the individual pieces of the target are shown. The feet 46 may be configured to have downwardly extending protrusions 60 to allow the feet 46 to rest more securely on ground which may be uneven. The feet 46 may also be formed with a slot 62. The slot 62 is typically configured to allow insertion of the frame 44 into the slot 62, allowing the feet 46 to be slid onto the lower portion of the frame 44*a*. The frame may have protrusions 64 against which the feet may rest when installed on the frame 44. The protrusions prevent the feet from sliding too far inwardly on the frame 44, making the target unstable.

The frame 44 may also have holes 66 on the lower portion 44*a* of the frame 44. Bolts can be placed through the holes 66 after the feet have been installed to prevent the feet 46 from sliding outwardly on the frame. Conversely, long spikes 68 may be inserted downwardly through the holes 66 after the feet 46 have been installed. The spikes 68 will prevent the feet from sliding outwardly on the frame 44, and also are long enough to extend downwardly into the ground and prevent the target from sliding.

The embodiment of the target shown is thus advantageous in that it may be used both on dirt, or more solid surfaces which do not readily allow for insertion of a spike to secure a target. On a hard surface, the feet 46 may be installed without spikes 68. The target will then rest on the surface. The feet 46 are sufficiently large to prevent the target from falling, and may be designed to also prevent the target from sliding if configured to have some relatively sharp points or corners on the bottom of the feet 46 or the protrusions 60 on the feet 46. The same target, if used on softer ground, may be securely attached to the ground by inserting spikes 68 through the holes 66 in the lower portion of the frame 44*a*.

The frame 44 is typically constructed from flat plate steel with two bends 70 to shape the frame into a U shape. It is advantageous to construct the frame 44 from bent plate steel as compared to welded steel, as the bends will be less prone to failure that welds. Additionally, the bends 70 are placed at a reasonable distance away from the shooting plate 42. This lessens the impact of the vibrations and stresses on the bends 70 resulting from the bullets striking the shooting plate 42. The design is particularly advantageous because the entire shooting plate 42 is constructed from a single piece of plate steel. Also shown in FIG. 4 are the holes 52 in the frame 44 which may be used to attach multiple targets together.

The shooting plate 42 is shown with target plates 42*b* and 42*c* of different sizes. Round target plates 42*b* and 42*c* are shown, but it will be appreciated that many shapes may be used.

Figure 5:
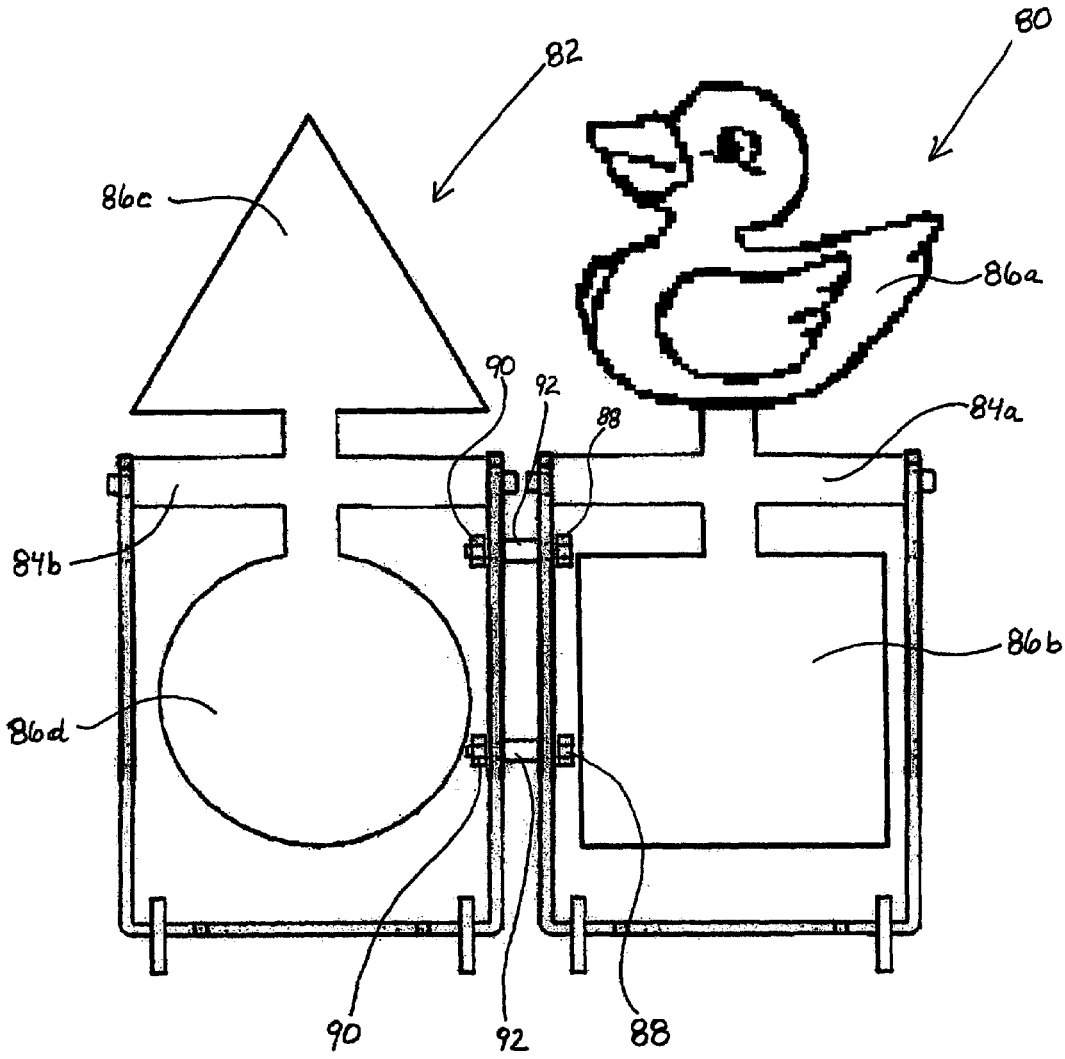
FIG. 5 shows a perspective view of multiple targets used together in accordance with the principles of the present invention.

Turning now to FIG. 5, a perspective view is shown of two targets, indicated generally at 80 and 82, used in combination. Individuals may desire to use multiple targets in combination to provide different training options. For example, the shooting plates 84*a* and 84*b* may be selected such that the target plates 86*a–d* present a variety of shapes and colors to the individual using the targets 80 and 82 for target practice. Using target plates 86*a–d* which are of different shapes or colors, a trainer may call out or otherwise signal various shapes or colors and require the shooter to quickly identify the corresponding target and shoot appropriately.

When multiple targets 80 and 82 are used in combination, the user may desire to attach the targets together with bolts 88 and nuts 90. The user may also use a spacer 92 place between the targets 80 and 82 to maintain a proper distance between the targets 80 and 82 so as to allow the shooting plates 84*a* and 84*b* to move freely. Attaching the targets 80 and 82 together with bolts 88 and nuts 90 allows the user to more easily fix the arrangement of the targets 80 and 82 relative to one another, provides some added measure of stability to the targets 80 and 82, and limits the number of feet needed to stabilize the target.

Although the bolts 88 and nuts 90 are exposed to stray bullets which might hit the bolts 88 or nuts 90 instead of the target plates 86*a–d*, the bolts 88 and nuts 90 are not an important structural part of the targets 80 and 82, as both of the targets 80 and 82 are designed as separate, stand-alone targets and do not rely on the bolts 88 or nuts 90 for structural integrity. If the bolts 88 or nuts 90 are hit and damaged by a few stray bullets, they may simply be replaced when the user disassembles and reassembles the targets 80 and 82 for use in combination. Because the targets 80 and 82 are portable, it is anticipated that the targets 80 and 82, if used in combination, will be bolted together when set up for a day of target practice and unbolted when taken down for the day. If the user desires to again use the targets 80 and 82 in combination for a different target practice session, the user will be able to easily determine if the bolts 88 or nuts 90 have been damaged, and be able to replace damaged bolts 88 or nuts 90 when setting up the targets 80 and 82.

One significant advantage of the present invention is that the entire target can be cut from a single piece of hardened plate steel. A piece of plate steel can be placed on a cutting table and an automated cutting torch or other cutting device can cut out each of the pieces. The only handling necessary it to make two quick bends in the frame and the target is ready for shipping.

Thus, there is disclosed an improved target. Those skilled in the art will appreciate that numerous modifications can be made with out departing from the scope of the invention. The appended claims are intended to cover such modifications.

What is claimed is:

1. A portable bullet target comprising:

a frame formed from steel plate; and a shooting plate formed as a single piece of steel plate, the shooting plate comprising a target plate configured for being struck by bullets, a connecting portion attached to the target plate, a first arm extending sideways from the connecting portion, and a second arm extending sideways from the connecting portion in a direction generally opposite from the first arm, the first and second arms having projections extending from the ends thereof for engaging the frame and configured for enabling the shooting plate to pivot rearwardly and forwardly when struck by a projectile.

2. The target of claim 1, wherein the frame is bent into a generally U-shaped.

3. The target of claim 1, further comprising at least one foot attached to the frame.

4. The target of claim 3, wherein the foot is attached to the frame by sliding over the frame, and wherein the frame further comprises at least one projection configured for limiting movement of the at least one foot.

5. The target of claim 3, wherein the frame further comprises at least one hole whereby a bolt or pin may be inserted to limit movement of the at least one foot.

6. The target of claim 3, wherein the at least one foot further comprises a slot configured to receive the frame.

7. The target of claim 1, wherein the first arm and the second arm form a cross piece.

8. The target of claim 7, wherein the shooting plate further comprises two target plates, and wherein the two target plates are disposed on opposite sides of the cross piece.

9. The target of claim 1, wherein the shooter plate comprises two target plates and wherein the two target plates are disposed on opposite sides of the first arm and second arm.

10. The target of claim 7, wherein the shape of the at least one target plate is selected from the group consisting of: a circle, an oval, a square, a triangle, a rectangle, a polygon, and an animal.

11. The target of claim 1, wherein the frame comprises an elongate piece of plate steel which is bent in at least one location along the elongate piece of plate steel to form an open sided polygon.

12. The target of claim 1, wherein the frame further comprises two holes configured to receive the two projections.

13. The target of claim 1, wherein the frame is formed from a strip of steel bent generally into a U shape, and wherein the frame further comprises at least one hole configured for attachment to another similar frame.

14. The target of claim 1, wherein the frame further comprises at least one hole through which a spike may be inserted, and wherein the spike is inserted through the at least one hole and inserted into the ground to stabilize the target.

15. The target of claim 1, wherein the shooting plate is painted.

16. The target of claim 7, wherein the at least one target plate is painted.

17. The target of claim 9, wherein the two target plates are painted different colors.

18. The target of claim 1, further comprising feet disposed in engagement with the frame for holding the frame in an orientation less than vertical.

19. A target system comprising a target in accordance with claim 1, and further comprising a second target comprising a frame and a shooting plate mounted in the frame the second target being removably attached to the first target by attaching the first target frame to the second target frame.

20. The target system according to claim 19, wherein the first target frame has a hole formed therein and the second target frame has a hole formed therein, and further comprising a fastener for passing through the holes in the first target frame and second target frame and thereby holding the frame and second frame together.

21. The target of claim 1, wherein the connecting portion extends away from the target plate.

22. The target of claim 1, wherein the shooting plate is flat.

23. A portable target formed from pieces of plate steel comprising:

a generally flat target plate with first and second arms formed as a single piece of plate steel, the target plate having said first arm extending outwardly and said second arm extending outwardly on said side opposite the first arm, and having a first target formed generally above the arms and a second target formed generally below the arms; and a frame configured for receiving the arms so as to allow the target to pivot when hit by a bullet.

24. The portable target of claim 23, further comprising protrusions formed on the ends of the arms.

25. The portable target of claim 24, wherein the protrusions nest in holes formed in the frame to form a hinge.

26. The portable target of claim 23, wherein the frame is formed from a single piece of steel plate bent into a generally U-shaped configuration, and wherein the arms nest in holes formed at the open end of the frame.

27. The portable target of claim 23, wherein the frame is formed from a strip of steel plate, and wherein the target further comprising at least one foot formed from a piece of flat steel plate, the at least one foot having a slot formed therethrough, and wherein the at least one foot is slidably disposed on the frame.

28. The portable target of claim 27, wherein the frame has a projection disposed thereon for limiting movement of the foot.

29. The portable target of claim 27, wherein the foot holds the frame at a position less than vertical.

* * * * *

UNITED STATES PATENT AND TRADEMARK OFFICE

CERTIFICATE OF CORRECTION

PATENT NO. : 7,175,181 B1
APPLICATION NO. : 11/153178
DATED : February 13, 2007
INVENTOR(S) : Kyle Bateman, Kyle Burdette and Tom Marshall It is certified that error appears in the above-identified patent and that said Letters Patent is hereby corrected as shown below:

Column 2:
Line 28, it reads "...is formed by an protrusion of metal"; should read --...is formed by a protrusion of metal--
Line 55, it reads "from projectiles..."; should read --with projectiles...--
Line 58, it reads "...a significant of splatter..."; should read --...a significant amount of splatter...--

Column 3:
Line 34, it reads "...target known to the prior art..."; should read --...target known in the prior art...--

Column 6:
Line 7, it reads "to failure that welds."; should read --to failure than welds.--
Line 34, it reads "...use a spacer 92 place"; should read --...use a spacer 92 placed--

Column 7:
Line 21, it reads "generally U-shaped."; should read --generally U-shape.--

Signed and Sealed this

Tenth Day of February, 2009

JOHN DOLL
*Acting Director of the United States Patent and Trademark Office*